US008183486B2

(12) United States Patent
Tredoux et al.

(10) Patent No.: US 8,183,486 B2
(45) Date of Patent: May 22, 2012

(54) SPRING ARRANGEMENT FOR SPRING DRIVE UNIT AND SPRING DRIVE UNIT COMPRISING SPRING ARRANGEMENT

(75) Inventors: Johannes Tredoux, Ludvika (SE); Staffan Jacobsson, Grangarde (SE)

(73) Assignee: ABB Technology AG (CH)

( * ) Notice: Subject to any disclaimer, the term of this patent is extended or adjusted under 35 U.S.C. 154(b) by 735 days.

(21) Appl. No.: 12/342,926

(22) Filed: Dec. 23, 2008

(65) Prior Publication Data

US 2009/0166167 A1 Jul. 2, 2009

(30) Foreign Application Priority Data

Dec. 28, 2007 (EP) ..... 07124149

(51) Int. Cl.
*H01H 5/00* (2006.01)

(52) U.S. Cl. ..... 200/400; 267/166; 267/176

(58) Field of Classification Search ..... 267/166, 267/170, 174, 176; 200/400
See application file for complete search history.

(56) References Cited

U.S. PATENT DOCUMENTS 4,319,108 A * 3/1982 Chabala ..... 200/308
5,223,813 A * 6/1993 Cambreleng et al. ..... 337/66
6,831,244 B2 * 12/2004 Kawamoto et al. ..... 218/78
2004/0020899 A1 2/2004 Kawamoto et al.
2007/0163869 A1 7/2007 Courbon et al.
2009/0166167 A1 * 7/2009 Tredoux et al. ..... 200/400
2009/0166938 A1 * 7/2009 Westfalt et al. ..... 267/140.11

FOREIGN PATENT DOCUMENTS

FR 2778492 A1 11/1999
JP 9259710 A 10/1997

OTHER PUBLICATIONS

Extended European Search Report; EP 07 12 4149; May 27, 2008; 6 pages.

* cited by examiner

*Primary Examiner* — James Harvey

(74) *Attorney, Agent, or Firm* — St. Onge Steward Johnston & Reens LLC

(57) ABSTRACT

The invention describes a spring arrangement for spring drive unit, which spring arrangement comprises a spring, a pullrod connected at a first pullrod end to a first spring end of the spring and connected at an opposite second pullrod end to a rotary shaft of the spring drive unit, a frame plate against which a second spring end of the spring is mounted and the frame plate being provided with an opening through which the pullrod extends to be connected to the shaft. Further, the first spring end of the spring, to which the pullrod is connected, is unguided, and the parameters of the spring are chosen in response to the operating conditions of the spring drive unit such that the spring is stable during operation.

16 Claims, 1 Drawing Sheet

SPRING ARRANGEMENT FOR SPRING DRIVE UNIT AND SPRING DRIVE UNIT COMPRISING SPRING ARRANGEMENT

CROSS-REFERENCE TO RELATED APPLICATIONS

The present application claims priority of European patent application No. 07124149.1 filed on Dec. 28, 2007, the content of which is incorporated herein by reference.

FIELD OF THE INVENTION

The present invention relates to a spring arrangement for a spring drive unit, e.g. for driving and controlling the opening and closing of an electrical switching apparatus, such as a switch or a circuit breaker. The said switching apparatus is meant to be used in a high or a medium voltage transmission or distribution network and is thus used at voltages ranging from one kilovolt to several hundreds of kilovolts. The spring drive unit may operate circuit breakers of all types, e.g. gas, oil or vacuum insulated circuit breakers of the live tank or dead tank type.

Spring drive units can also be used in other applications. In principle, they may be used anywhere where there is a need to move something very fast.

The present invention also relates to a spring drive unit comprising the inventive spring arrangement, and use of the inventive spring drive unit for driving and controlling the opening and closing of an electrical switching apparatus.

BACKGROUND OF THE INVENTION

In a power transmission or distribution network, switching apparatuses are incorporated into the network to provide automatic protection in response to abnormal load conditions or to permit opening or closing (switching) of sections of the network. The switching apparatus may therefore be called upon to perform a number of different operations such as interruption of terminal faults or short line faults, interruption of small inductive currents, interruption of capacitive currents, out-of- phase switching or no-load switching, all of which operations are well known to a person skilled in the art.

In switching apparatuses the actual opening or closing operation is carried out by two contacts where normally one is stationary and the other is mobile. The mobile contact is operated by an operating device which comprises an actuator and a mechanism, where said mechanism operatively connects the actuator to the mobile contact.

Actuators of known operating devices for medium and high voltage switches and circuit breakers are of the spring operated, the hydraulic or the electromagnetic type. In the following, operating devices will be described operating a circuit breaker but similar known operating devices may also operate switches.

The spring operated actuator, or spring drive unit as it also is called, generally uses two compression springs for operating the circuit breaker; an opening spring for opening the circuit breaker and a closing spring for closing the circuit breaker and re-loading the opening spring. The closing spring is recharged by an electrical motor which is situated in the operating device. A mechanism converts the motion of the springs into a translation movement of the mobile contact. In its closed position in a network the mobile contact and the stationary contact of the circuit breaker are in contact with each other and the opening spring and the closing spring of the operating device are charged. Upon an opening command the opening spring opens the circuit breaker, separating the contacts. Upon a closing command the closing spring closes the circuit breaker and, at the same time, charges the opening spring. The opening spring is now ready to perform a second opening operation if necessary. When the closing spring has closed the circuit breaker, the electrical motor in the operating device recharges the closing spring. This recharging operation takes several seconds.

It is previously known to use helical springs in spring operated actuators or spring drive units. When the springs are charged or loaded, they are in a compressed state that is not inherently stable. They tend to buckle or roll if they are compressed into the unstable range, and consequently, they require some kind of guiding to prevent buckling. Therefore, in prior art, the springs are enclosed in guiding tubes or cylinders, with a lower end guide plate and the upper end mounted against a frame plate that may be part of the housing for the other parts of the operating device.

It is previously known from JP-A-9259710 to refrain from the use of a guiding tube and allegedly prevent buckling of the spring by instead using other types of guide means, for example one or several guide rods attached to the frame plate and extending down inside the spring to and through a hole in a spring disc at the lower end of the spring. In this way the spring end will certainly still be guided but that does not necessarily mean that the spring does not buckle. This also has the disadvantage of adding extra elements to the structure.

In the currently most common designs of the charging and discharging mechanism of a spring drive unit, the compression and decompression of the opening and closing springs are obtained by a rotary motion of a shaft to which respective spring pullrods are connected. This rotary motion leads to a deflection of the pullrod, and with the traditional designs the deflection, or pullrod angle, of the closing spring is usually larger than for the opening spring. Consequently, the risk for buckling is higher for the closing spring and the demands on the guiding tube are higher.

SUMMARY OF THE INVENTION

The object of the present invention is to provide a spring arrangement for spring drive units in general, and in particular for spring drive units arranged in operating devices for driving and controlling the opening and closing of an electrical switching apparatus, such as a switch or a circuit breaker, which arrangement is light and cost effective.

According to the present invention is defined a spring arrangement for spring drive unit, which spring arrangement comprises a spring, a pullrod connected at a first pullrod end to a first spring end of the spring and connected at an opposite second pullrod end to a rotary shaft of the spring drive unit, a frame plate against which a second spring end of the spring is mounted and the frame plate being provided with an opening through which the pullrod extends to be connected to the shaft, characterized in that the first spring end of the spring, to which the pullrod is connected, is unguided, and that the parameters of the spring are chosen in response to the operating conditions of the spring drive unit such that the spring is stable during operation.

By a stable spring is meant a spring that does not buckle or roll under the foreseen operating conditions. It should be inherently stable. The foreseen parameters of the operating conditions for a spring in a spring drive unit are the expected maximum compression force, how much the spring is compressed, the stroke and the pullrod angle. Since these parameters are well known and easy to determine with sufficient accuracy, it will not pose a problem to establish what the demands are that decide the choice of spring for each spring drive installation.

The foreseen parameters of the spring in the present circumstances are the length of the spring, the diameter (width) of the spring and diameter of the used wire for the spring. It is in particular the ratio between length and width that is used when choosing the spring. By means of the present invention is obtained a spring arrangement that provides a stable spring and where no guiding tubes are needed, it has fewer components than in prior art, less weight, it is cheaper and more cost effective.

According to an aspect of the present invention, the pullrod is provided with a joint on a part of the pullrod that is located between the first pullrod end, where the pullrod is connected to the first spring end, and the frame plate. By means of providing a joint on the pullrod, is achieved the advantage of limiting the sideways movement of the unguided first end of the spring. During compression, the unguided spring end does not move linearly, instead it bends or rotates to the side so that the spring ends do not stay parallel to each other. When the spring is released, which is a very fast event, the unguided spring end may start swinging or rotating and this may cause damage to anything that is close to the spring end. In spring drive units where there are two springs, one closing spring and one opening spring, if one of the springs starts swinging it may damage the other spring. This will be prevented by having a joint on at least one of the pullrods. It is desirable that the position of the unguided spring end is predictable for a given load.

According to a further aspect of the invention, the joint divides the pullrod in two parts, a first pullrod part connected to the spring disc by the first end of the pullrod, and a second pullrod part connectable to a rotary shaft of a spring drive unit.

According to yet a further aspect, the joint is located so that an adequate counter torque is created that balances a maximum transversal load resulting from a pullrod deflection angle.

According to a further aspect of the invention, the location of the joint is decided such that the weight of the spring is minimized.

The present invention also relates to a spring drive, comprising an opening spring arrangement and a closing spring arrangement, each spring arrangement comprising a spring, a pullrod, and a frame plate, which spring drive is characterized in that at least one of the spring arrangements is designed in accordance with a spring arrangement as defined above.

Furthermore, the present invention relates to a spring drive unit comprising an opening spring arrangement and a closing spring arrangement, each spring arrangement comprising a spring, a pullrod and a frame plate, characterized in that the spring arrangement of the opening spring is designed in accordance with claim 1, and the spring arrangement of the closing spring is designed in accordance with any one of claims 2-5.

Finally, the present invention relates to the use of the defined spring drive unit for driving and controlling the opening and closing of an electrical switching apparatus.

Further features and advantages of the present invention will become apparent from the following detailed description of the invention.

BRIEF DESCRIPTION OF THE DRAWINGS

The present invention will now be described in more detail with reference to the enclosed drawings, illustrating an embodiment of the invention as an example only, in which.

DETAILED DESCRIPTION OF THE INVENTION

Figure 1:
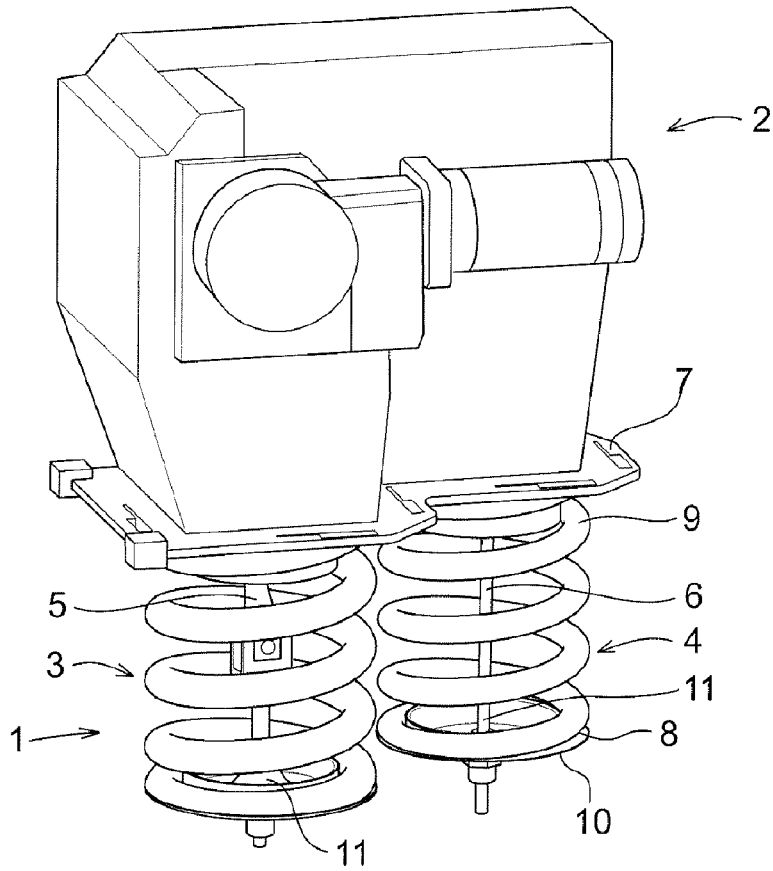
FIG. 1 illustrates a spring drive unit provided with spring arrangements according to an embodiment of the present invention.

In FIG. 1 is shown an embodiment of a spring arrangement 1 according to the present invention, installed on a spring drive unit 2 used in electrical switch gear, such as a circuit breaker for medium and high voltages. The main parts and the operation of a spring drive unit used for circuit breakers and switches have already been described above.

The basic components of a spring drive unit are two springs, one closing spring 3 for closing the switch and one opening spring 4 for opening the switch. Since many of the details of the opening spring 4 and the closing spring 3 are identical, some of the reference numbers for these details are only indicated for one of the springs, namely the opening spring. Each spring is connected to a charging and discharging mechanism (not shown) inside the housing of the spring drive unit 2, by means of pullrods 5, 6. Each spring has a lower first spring end 8 to which a first pullrod end 11 is connected, e.g. via a spring disc 10, and an upper second spring end 9 that is mounted on a frame plate 7. The frame plate 7 may or may not be part of the housing of the spring drive unit. The frame plate is preferably provided with some kind of guiding means for the spring such that it is radially guided in order to keep its position. The frame plate is also provided with an opening passage for the pullrod of each respective spring.

The first, lower end 8 of the spring is unguided. In operation the springs 3, 4 are compressed by pulling on the pullrods 5, 6.

Figure 2:
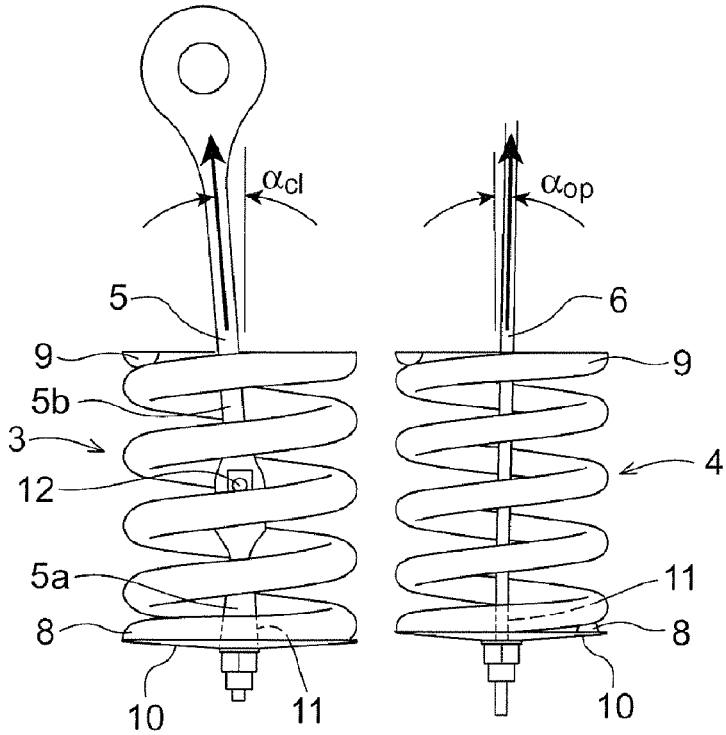
FIG. 2 shows details of an embodiment of spring arrangements according to the present invention.

FIG. 2 shows an embodiment of the present invention comprising a spring arrangement for a closing spring 3 and a spring arrangement for an opening spring 4 in a spring drive unit. The lower first end 11 of the respective pullrod 5, 6 and the lower first end 8 of the respective spring are connected via a spring disc 10. The frame plate 7 has been left out in this figure, for clarity reasons. As described above, the upper ends of the respective pullrods 5, 6 are connected to a rotary shaft (not shown) of the spring drive unit 2. During a stroke, the pullrod deflects from its straight transversal position, by an angle, the pullrod deflection angle $\alpha$, called simply the pullrod angle, which creates a transversal load. The maximum pullrod angle is reached when the stroke is at nine o'clock. For the opening spring 4, the pullrod angle $\alpha_{op}$ varies only a little through a stroke. As can be seen, the lower first end 8 of the spring is unguided. The parameters of the spring have been chosen in relation to the operating conditions, such as maximum compression force, how much the spring is compressed, the stroke and the maximum pullrod angle $\alpha_{op}$. The parameters have been chosen such that the spring is stable during the entire operation cycle. The parameters of the spring are the length of the spring, the width, i.e. the diameter of the spring, the diameter of the used wire for the spring. A wide and short spring is more stable than a long spring with small diameter.

For the closing spring 4, the pullrod angle $\alpha_{cl}$ varies significantly through the stroke. This will also result in a sideways movement of the unguided end of the spring which is more pronounced than for the opening spring with a smaller pullrod angle. Since it is desirable that the end position of the unguided end is always predictable during compression and that a rotation or swinging of the unguided end is avoided during release of the spring, as explained above, a joint 12 is provided on the pullrod 5. This joint is located some distance above the spring disc 10, to which the first pullrod end 11 is connected, to further enhance stability and optimize the arrangement. The joint 12 divides the pullrod in two parts, a first lower pullrod part 5*a* connected to the spring disc 10 by the first end 11 of the pullrod, and a second upper pullrod part 5*b* connected to a rotary shaft. The parameters of the spring and the joint, such as the exact location of the joint, are balanced against each other. In many cases it is a wish to minimize the weight of the spring that is the guiding principle. It should also be considered that the location of the joint should be located so that an adequate counter torque is created that balances the maximum transversal load resulting from the pullrod angle $\alpha_{cl}$. The illustrated joint is a pivot joint of the pin type, but it is equally possible to have other types of joint, such as a ball joint for example.

The present invention is not limited to the described embodiment, given as example only, but can be modified in various ways by a person skilled in the art within the scope as defined in the appended patent claims.

What is claimed is:

1. Spring arrangement for spring drive unit, which spring arrangement comprises a spring, a pullrod connected at a first pullrod end to a first spring end of the spring and connected at an opposite second pullrod end to a rotary shaft of the spring drive unit, a frame plate against which a second spring end of the spring is mounted and the frame plate being provided with an opening through which the pullrod extends to be connected to the shaft, characterized in that the first spring end of the spring, to which the pullrod is connected, is unguided, and wherein the pullrod is provided with a joint on a part of the pullrod that is located between the first pullrod end, where the pullrod is connected to the first spring end, and the frame plate.

2. A method for using a spring arrangement comprising the step of:

charging an opening spring arrangement;

charging a closing spring arrangement;

the opening spring arrangement and the closing spring arrangement each comprising:

a rotary shaft;

a frame plate having an opening;

a spring having a first end and a second end opposite the first end, the second end connected to the frame plate;

a pullrod extending through the opening of the frame plate having a first end and a second end opposite the first end, the first end of the pullrod connected to the first end of the spring, and the second end of the pullrod connected the rotary shaft;

wherein the second end of the spring is guided by the frame plate and the first end of the spring is unguided.

3. Spring arrangement according to claim 1, characterized in that the joint divides the pullrod in two parts, a first pullrod part connected to a spring disc by the first end of the pullrod, and a second pullrod part connectable to a rotary shaft of a spring drive unit.

4. Spring arrangement according to claim 1, characterized in that the joint is located so that an adequate counter torque is created that balances a maximum transversal load resulting from a pullrod deflection angle $\alpha_{cl}$.

5. Spring arrangement according to claim 1, characterized in that the location of the joint is decided such that the weight of the spring is minimized.

6. The spring arrangement of claim 1, further comprising a second spring arrangement, wherein the spring arrangement is an opening spring arrangement and the second spring arrangement is a closing spring arrangement comprising a spring, a pullrod and a frame plate.

7. The method of claim 2, further comprising a joint on the pullrod of the opening spring arrangement and a joint on the pullrod of the closing spring arrangement.

8. The method of claim 7, wherein the joint divides the pullrod into two parts, a first pullrod part connected to a spring disc by the first end of the pullrod, and a second pullrod part connected to the rotary shaft of the spring drive unit.

9. A spring arrangement for spring drive unit comprising:

a rotary shaft;

a frame plate having an opening;

a spring having a first end and a second end opposite said first end, said second end connected to said frame plate;

a pullrod extending through said opening of said frame plate having a first end and a second end opposite said first end, said first end of said pullrod connected to said first end of said spring, and said second end of said pullrod connected said rotary shaft;

wherein said second end of said spring is guided by said frame plate and said first end of said spring is unguided.

10. The spring arrangement according to claim 9, further comprising a joint on said pullrod.

11. The spring arrangement according to claim 10, wherein said joint divides said pullrod into two parts, a first pullrod part connected to a spring disc by said first end of the pullrod, and a second pullrod part connected to said rotary shaft of said spring drive unit.

12. The spring arrangement according to claim 10, wherein said joint is located so that an adequate counter torque is created that balances a maximum transversal load resulting from a pullrod deflection angle $\alpha_{cl}$.

13. Spring The spring arrangement according to claim 10, wherein a location of said joint is determined such that the weight of the spring is minimized.

14. The spring arrangement of claim 1, further comprising a second spring arrangement, wherein said spring arrangement is an opening spring arrangement and said second spring arrangement is a closing spring arrangement comprising a spring, a pullrod and a frame plate.

15. The method of claim 7, wherein the joint is located so that an adequate counter torque is created that balances a maximum transversal load resulting from a pullrod deflection angle $\alpha_{cl}$.

16. The method of claim 7, wherein a location of the joint is determined such that the weight of the spring is minimized.

* * * * *